US009967680B2

(12) United States Patent
Höjlund et al.

(10) Patent No.: US 9,967,680 B2
(45) Date of Patent: May 8, 2018

(54) FREQUENCY BASED FEEDBACK CONTROL

(71) Applicant: Cochlear Limited, Macquarie University, NSW (AU)

(72) Inventors: Mats Höjlund, Mölnlycke (SE); Martin Hillbratt, Lindome (SE)

(73) Assignee: Cochlear Limited, Macquarie University, NSW (AU)

( * ) Notice: Subject to any disclaimer, the term of this patent is extended or adjusted under 35 U.S.C. 154(b) by 0 days. days.

(21) Appl. No.: 15/138,488

(22) Filed: Apr. 26, 2016

(65) Prior Publication Data

US 2016/0241969 A1 Aug. 18, 2016

Related U.S. Application Data

(62) Division of application No. 13/741,297, filed on Jan. 14, 2013, now Pat. No. 9,351,085.

(60) Provisional application No. 61/740,437, filed on Dec. 20, 2012.

(51) Int. Cl.
*H04R 25/00* (2006.01)
*G10L 21/0232* (2013.01)

(52) U.S. Cl.
CPC ..... *H04R 25/353* (2013.01); *G10L 21/0232* (2013.01); *H04R 25/453* (2013.01); *H04R 25/505* (2013.01); *H04R 25/606* (2013.01)

(58) Field of Classification Search
CPC ..... H04R 25/45; H04R 25/453; H04R 3/02
See application file for complete search history.

(56) References Cited

U.S. PATENT DOCUMENTS

| | | | | |
|---|---|---|---|---|
| 6,404,895 | B1 | 6/2002 | Weidner | |
| 7,365,669 | B1 | 4/2008 | Melanson | |
| 7,711,133 | B2 | 5/2010 | Goorevich et al. | |
| 8,090,118 | B1 | 1/2012 | Pandey et al. | |
| 2004/0125966 | A1 | 7/2004 | Weidner | |
| 2009/0028366 | A1 | 1/2009 | Tklinkby | |
| 2010/0166198 | A1* | 7/2010 | Perman | H04R 25/453 381/60 |
| 2011/0175678 | A1 | 7/2011 | Velazquez | |
| 2012/0185524 | A1 | 7/2012 | Clark | |
| 2012/0195450 | A1 | 8/2012 | Foeh et al. | |

* cited by examiner

*Primary Examiner* — Matthew Eason

(57) ABSTRACT

Disclosed herein is a feedback reduction system for used in a hearing prosthesis. The hearing prosthesis will receive an input signal, process the input signal, and create a transformed output. However, the hearing prosthesis may suffer from feedback. Thus, a system to minimize the feedback in a hearing prosthesis may be desirable. One system to minimize the feedback includes down-sample circuitry configured to down-sample a first signal, creating a down-sampled signal. They system also includes a filter circuit. The filter circuit filters both the first signal and the down-sampled signal. The filter will output a filtered signal and a filtered down-sampled signal, respectively. Additionally, the system features up-sample circuitry that up-samples the filtered down-sampled signal. The output of the up-sample circuitry is an up-sampled signal. Further, the system features combining circuitry that creates a feedback-reduced signal based on the up-sampled signal, the filtered signal, and an input signal.

27 Claims, 5 Drawing Sheets

FREQUENCY BASED FEEDBACK CONTROL

CROSS REFERENCE TO RELATED APPLICATIONS

The present application is a divisional application of U.S. patent application Ser. No. 13/741,297 filed Jan. 14, 2013, which claims priority to U.S. Provisional Patent Application Ser. No. 61/740,437, filed on Dec. 20, 2012, the entire contents of each of which are incorporated herein by reference

BACKGROUND

Various types of hearing prostheses may provide people having different types of hearing loss with the ability to perceive sound. Hearing loss may be conductive, sensorineural, or some combination of both conductive and sensorineural hearing loss. Conductive hearing loss typically results from a dysfunction in any of the mechanisms that ordinarily conduct sound waves through the outer ear, the eardrum, or the bones of the middle ear. Sensorineural hearing loss typically results from a dysfunction in the inner ear, including the cochlea, where sound vibrations are converted into neural signals, or any other part of the ear, auditory nerve, or brain that may process the neural signals.

People with some forms of conductive hearing loss may benefit from hearing prostheses, such as traditional hearing aids or other acoustic hearing prostheses. A traditional hearing aid typically includes a small microphone to detect sound, an amplifier to amplify certain portions of the detected sound, and a small speaker to transmit the amplified sound into the person's ear. Other acoustic hearing prostheses typically include a small microphone to detect sound, and a vibration mechanism to apply vibrations corresponding to the detected sound to a person's bone, thereby causing vibrations in the person's inner ear, thus bypassing the person's auditory canal and middle ear. Such acoustic hearing prostheses include bone conduction hearing devices, direct acoustic cochlear stimulation devices, and middle ear devices.

A bone conduction device typically utilizes a surgically-implanted mechanism to transmit sound via direct vibrations of an implant recipient's skull. An external component of the bone conduction device detects sound waves, which are converted into a series of electrical stimulation signals delivered to the implant recipient's skull bones via an electromechanical transducer (e.g., a mechanical actuator). By providing stimulation to the recipient's skull, the bone conduction device enables the recipient's middle ear and auditory canal to be bypassed, which is advantageous for recipients with medical conditions that affect the middle or outer ear. The vibrations of the recipient's skull bones cause fluid motion within the recipient's cochlea, thereby enabling the recipient to perceive sound based on the vibrations. Similarly, a direct acoustic cochlear stimulation device typically utilizes a surgically-implanted mechanism to transmit sound by directly moving the ossicular chain of the recipient, which causes fluid motion within the recipient's cochlea or directly moving the fluid within the recipient's cochlea. Other non-surgical vibration-based hearing aids may use similar vibration mechanisms to transmit sound via direct vibration of a recipient's teeth or other cranial or facial bones.

Each type of hearing prosthesis has an associated sound processor. In one basic embodiment, the sound processor provides amplification to any sounds received by the prosthesis. However, in other embodiments, the processor present in a hearing prosthesis may be more advanced. For example, some processors are programmable and include advanced signal processing functions (e.g., noise reduction functions).

Sound processing systems may unintentionally introduce feedback into the audio system. For example, in a generic sense, in a sound processing system with a microphone and speakers, sound captured by the microphone may be amplified and output by the speakers. However, a portion of the sound captured by the microphone may include the sound produced by the speakers. When the microphone captures the sound produced by the speakers, which is an amplification of the microphone signal, undesirable acoustic or audio feedback may be produced.

SUMMARY

Disclosed herein are systems and methods for reducing the feedback from a hearing prosthesis. One example includes a signal processing system, the system comprising a filter with a fixed number of output taps, first processing circuitry configured to provide one or the other of two signals to an input of the filter. The two signals including first and second signals. The first processing circuitry is further configured to generate the first signal by altering the bandwidth of the second signal, which is an output of the signal processing system. The system also includes combining circuitry configured to generate a processed signal from an input signal to the combining circuitry based on an output of the filter.

Another example includes a method of operating a signal processing system comprising a signal path. The method includes down-sampling outside of the signal path a first signal from the signal path, which creates a down-sampled signal. The method also includes filtering outside of the signal path the down-sampled signal, which creates a filter down-sampled signal and up-sampling outside of the signal path the filter down-sampled signal, which creates an up-sampled signal. Also, the method includes altering a second signal inside the signal path based on the up-sampled signal.

Still another example includes a signal processing system that comprises a first process circuit configured generate a first processed signal from an input to the first process circuit based on a first signal and a second process circuit configured generate a second processed signal from the first processed signal based on a second signal. The first signal is the first processed signal or an output of the signal processing system, the second signal is the second processed signal or the output of the signal processing system, and the first process circuit operates on a first frequency band, the second process circuit operates on a second frequency band, the first and second frequency bands are different, and the first and second frequency bands overlap.

DETAILED DESCRIPTION

Figure 1:
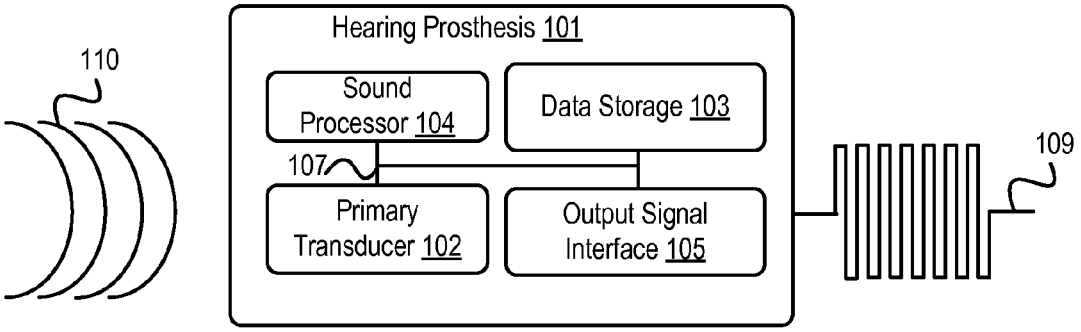
FIG. 1 is a block diagram of a hearing prosthesis according to one example.

For illustration purposes, the present disclosure is described generally with respect to vibration-based hearing devices. However, the embodiments and examples disclosed herein may be equally applicable to other types of hearing prostheses. Certain aspects of the disclosed systems and methods can be applicable to any type of hearing prosthesis now known or later developed. Further, some of the disclosed aspects can be applied to other acoustic devices or sound processors in general that are not necessarily associated with hearing prostheses.

In one embodiment, a disclosed feedback reduction system includes two filters: a pre-filter that is static (non-changing or very slowly changing) and a dynamic (changing) filter that is configured to adapt to changes in an electrical feedback path of the system. For performance reasons, the pre-filter has relatively few filter taps and, in some cases, it is not feasible to add additional taps. Due to this fixed or limited number of filter taps, low signal frequencies may be grouped together at one or more of the filter taps. Generally, a resolution of the filter is a function of the number of filter taps, thus, in some instances, the filter resolution for low signal frequencies may be limited. Due to this limited resolution of the filter for low frequencies, it can be challenging to target and reduce feedback at relatively low frequencies, e.g., frequencies below 1 kHz. In other embodiments, the system may only include the dynamic filter.

As disclosed in more detail herein, by down-sampling an input audio signal and, more particularly, as a result of down-sampling to isolate the low frequency components of the audio signal, the above-mentioned filter system can be used to create a higher-resolution signal based on the low frequency audio components. Generally, in the present disclosure, down-sampling the input audio signal has a similar effect as filtering the signal through a low-pass filter. If the previously mentioned pre-filter or dynamic filter is applied to the down-sampled signal, the filter will effectively work at higher resolution for low frequencies without adding filter taps or otherwise modifying the filter to increase the filter resolution. This effective increase in resolution is due to the same filter sampling a smaller bandwidth signal. If the down-sampled input audio signal is sampled for a period of time that is longer and in the same proportion as a down-sample factor, it will result in a sample of the same size as a sample of the full-bandwidth (non-down-sampled) input audio signal, but the down-sampled signal will only have the low-frequency components. In one example, the filtered down-sampled signal is then up-sampled before the system recombines or otherwise processes it with an input audio signal to reduce acoustic feedback. Additionally, the feedback reduction system may also sample and filter full-bandwidth input audio signals and process these full-bandwidth audio signals with filtered down-sampled signals to reduce acoustic feedback.

FIG. 1 shows one example of a hearing prosthesis 101 configured according to some embodiments of the disclosed systems and methods. In various embodiments, the hearing prosthesis 101 is a hearing prosthesis combining electrical stimulation (e.g., a cochlear implant or auditory brainstem implant) and a traditional hearing aid, a traditional hearing aid, a bone anchored hearing device or other vibration-based hearing prosthesis, a direct acoustic stimulation device, or any other type of hearing prosthesis configured to receive and process at least one signal from an audio transducer of the prosthesis and likely to generate feedback while generating a hearing precept.

The hearing prosthesis 101 includes a primary transducer 102, a data storage 103, a sound processor 104, and an output signal interface 105, all of which are connected directly or indirectly via circuitry 107. In other embodiments, the hearing prosthesis 101 may have additional or fewer components than the prosthesis shown in FIG. 1. For example, the hearing prosthesis 101 may include a secondary transducer in some embodiments. Additionally, the components may be arranged differently than shown in FIG. 1. For example, depending on the type and design of the hearing prosthesis, the illustrated components may be enclosed within a single operational unit or distributed across multiple operational units. Similarly, in some embodiments, the hearing prosthesis 101 additionally includes one or more processors (not shown) configured to determine various settings for the sound processor 104. The additional processors may be located in a computer external to the hearing prosthesis. The hearing prosthesis may be coupled to the computer either via a wire or wirelessly. The processor located in the external computer may perform some of the signal processing disclosed herein.

Figure 2:
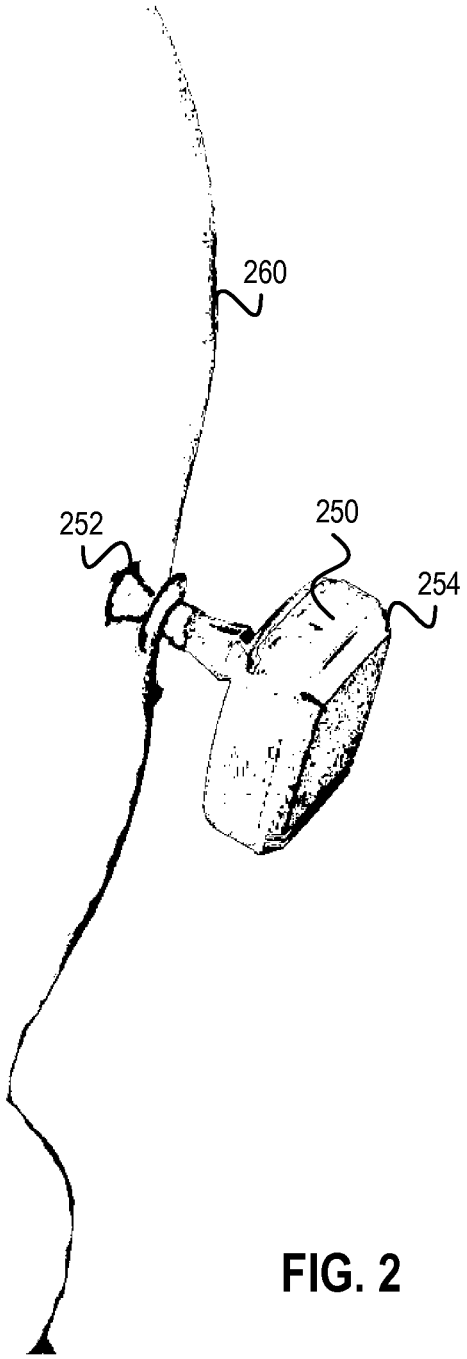
FIG. 2 is an example isometric view of a hearing prosthesis coupled to the head of a recipient.

In embodiments where the hearing prosthesis 101 is a vibration-based hearing prosthesis, the hearing prosthesis 101 can be physically coupled to a prosthesis recipient (as shown in FIG. 2, for example) to provide audio stimulation. In some embodiments, the primary transducer 102 is a microphone. The primary transducer 102 receives acoustic signals 110 and the sound processor 104 analyzes and encodes the acoustic signals 110 into a group of electrical stimulation signals for application to an output signal interface 105.

In one example, for a vibration-based hearing prosthesis, the output signal interface 105 includes an electromechanical transducer (e.g. a mechanical actuator, a piezoelectric transducer, a piezomagnetic transducer, or magnetostrictive transducer) and the output signals are mechanical vibration signals. In the present example, the output signal interface 105 converts the electrical stimulation signals into physical vibrations and conducts the physical vibrations as an output signal 109 to the recipient. In operation, electrical signals supplied to the electromechanical transducer cause the transducer to generate mechanical vibration signals that are proportional to the electrical signals.

In some embodiments, a recipient has a bone-anchor implanted into his or her skull, through a process known as osseointegration. In some embodiments, the bone-anchored implant is made of titanium and is mounted directly in the skull bone of the recipient. In these embodiments, the hearing prosthesis attaches to the bone-anchored implant and directly vibrates the skull via the bone-anchored implant.

The bone-anchored implant generates vibrations that are conducted by the skull bones to the cochlea in the inner ear. If a recipient has conductive hearing loss (i.e., a hearing loss due to an issue in either the outer ear or middle ear) the pathway for sound transmission through the ear to the cochlea may not be functioning correctly. Therefore, the bone-anchored implant bypasses the portion of the ear with the issue causing hearing loss. The mechanical vibration signals 109 generated by the hearing prosthesis are conducted through bones of the head to cause fluid motion in the recipient's cochlea. And the fluid motion in the cochlea causes the recipient to experience sound sensations corresponding to the sound waves received by the transducer 102 and encoded by the processor 104.

In some embodiments, the sound processor 104 is located in a separate component (not shown). For example, the sound processor 104 may be located in a standard computer, a laptop computer, a tablet computing device, a mobile device such as a cellular phone, or a custom computing device or in dedicated separated housing. The primary transducer 102 may wirelessly communicate signals to the sound processor 104, which can process the signal as described herein. Further, the external portion may also include a secondary transducer (not shown). The secondary transducer may be the same type of transducer as the primary transducer 102. However, in some embodiments, the secondary transducer is a different type of transducer than the primary transducer 102. For example, the primary transducer 102 may be a microphone and the secondary transducer may be a vibration sensor.

FIG. 2 shows an example of a bone conduction device 250 coupled to a recipient 260 of the bone conduction device 250. In one embodiment, the bone conduction device 250 is directly attached to the body of a recipient 260 via an implant 252. The bone conduction device 250 typically includes a housing 254 that at least partially encloses one or more of the components of FIG. 1, such as the primary transducer 102 for detecting sound, the sound processing unit 104, the data storage 103, and the output signal interface 105.

As described with respect to FIG. 1, in some embodiments, a recipient has a bone-anchor implanted to his or her skull. However, in other embodiments, the hearing prosthesis may not be coupled to an implant, but rather may be in contact with the head of the prosthesis recipient. For example, the hearing prosthesis may be brought in contact with the side of a recipient's head. In still other embodiments, the prosthesis may be connected to a tooth of the prosthesis recipient and conduct vibrations via the teeth. In some embodiments, the bone conduction device 250 may suffer from low-frequency feedback due to the conducted mechanical vibrations. Thus, it may be desirable to have a system for reducing the low-frequency feedback.

Figure 3:
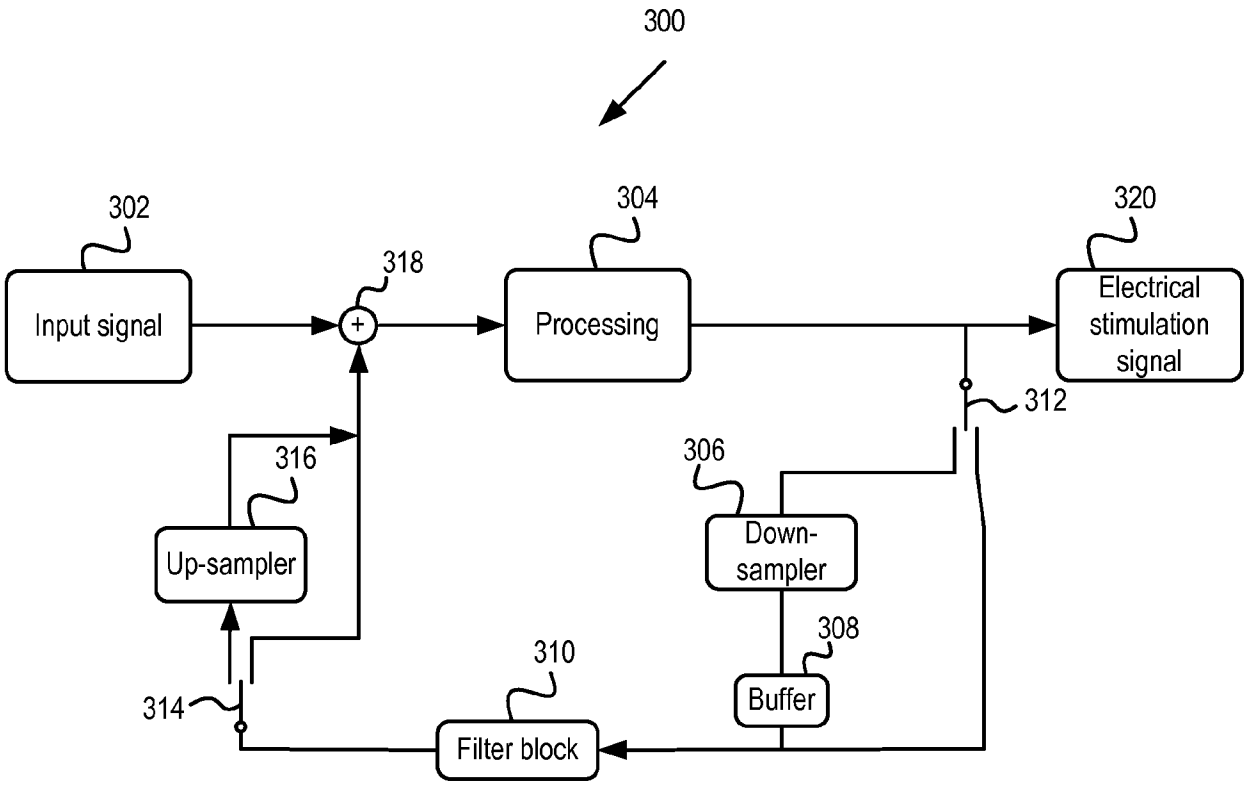
FIG. 3 is a block diagram of a sound processor including a single feedback reduction circuit, in accordance with one example.

FIG. 3 is a block diagram of an example sound processor system 300 (such as the processor 104 of FIG. 1) including a single feedback reduction circuit and other circuitry. Generally, the sound processor 300 transforms an input audio signal 302 into an output such as electrical stimulation signal 320, which in some embodiments is coupled to an electromechanical transducer. The sound processor 300 may perform some audio processing at processing block 304. For example, the processing block 304 may filter and process the input audio signal 302. The processing block 304 may receive the input audio signal 302 and convert it to an electrical stimulation signal 320 based on a set of processing parameters.

In some embodiments, the hearing prosthesis 101 is programmed with parameters specific to a given prosthesis recipient. The processing block 304 may transform the input signal 302 based on these recipient-specific parameters. For example, recipient-specific parameters include acoustic gain tables, frequency response curves, and other audio parameters. In some embodiments, the recipient-specific parameters are based on a hearing impairment associated with the prosthesis recipient. The processing block 304 may be similar to audio processing components found in a traditional hearing prosthesis.

As described above, sound processing systems may unintentionally introduce feedback into the audio system. For example, in a bone conduction system, sound captured by the microphone may be amplified and output by the vibration transducer; however, a portion of the sound that the microphone captures may include the sound vibrations produced by the vibration transducer itself. When the microphone captures these sound vibrations from the vibration transducer an undesirable feedback may be produced. In the case of a bone-conduction system, the system may be more prone to low frequency sound vibration feedback.

In order to minimize feedback in the system, an example feedback reduction circuit as shown in FIG. 3 may be used. In FIG. 3, the components of sound processor 300 are organized in one example layout. However, the components may be arranged in different combinations and still function as disclosed herein. Further, some components may be omitted and other components may be added.

In the embodiment shown in FIG. 3, a signal path is formed between input signal 302, combiner circuitry 318, processing block 304, and the electrical stimulation signal 320. The other circuitry illustrated in FIG. 3 is outside of the signal path and does not add distortion or latency to the signal path.

In the embodiment shown in FIG. 3, the feedback reduction circuit is formed at least in part by switch 312, down-sampler 306, buffer 308, filter block 310, switch 314, up-sampler 316, and combining circuitry 318. The electrical stimulation signal 320 from the processing block 304 is coupled to the switch 312. The switch 312 may selectively connect the electrical stimulation signal 320 to either the down-sampler 306 or directly to filter block 310. The switch 312 controls the pathway used for processing electrical stimulation signal 320 through the feedback reduction circuit. When the switch 312 is in a first position, the electrical stimulation signal 320 is connected directly to the filter block 310 and traditional sampling may be performed by the sound processor 300. However, when the switch 312 is in a second position, the electrical stimulation signal 320 is connected to the down-sampler 306, which is configured to down-sample the signal, thus reducing the bandwidth of the sampled signal. More particularly, in one example, the down-sampler 306 is configured to down-sample frequency components of the electrical stimulation signal, thus effectively low pass filtering the signal and reducing the bandwidth, thereby increasing a filter resolution for these frequencies at the output of the filter. In some embodiments, a processor may determine when to cause switch 312 to change positions. For example, in some embodiments, when low frequency feedback is detected, sound processor system 300 may cause switch 312 to switch. In other embodiments, a device or processor external to the hearing prosthesis 101 may cause switch 312 to switch. In still other embodiments, a recipient of the hearing prosthesis 101 or care giver may cause switch 312 to switch via a user interface on hearing prosthesis 101 or via a wirelessly coupled smart phone or remote control.

In one example, a down-sampling rate utilized by the down-sampler 306 may be chosen based on the Nyquist-Shannon sampling theorem and the bandwidth of the signals to be sampled. Generally, according to the Nyquist-Shannon sampling theorem, a signal should be sampled with a sampling rate at least equal to twice its bandwidth to make sure that the entire frequency range of the signal may be sampled. If the sample rate selected is less than twice the signal bandwidth, sampling will not happen fast enough to capture the high-frequency components of the signal. Only the lower frequency components will be captured if the rate is too low. Thus, by limiting a sampling rate, a signal may be effectively low-pass filtered. However, in some embodiments, it may be desirable to low pass filter a signal before down-sampling to minimize aliasing.

The down-sampler 306 is configured to sample the electrical stimulation signal 320 at a lower rate than would be used to sample the full-bandwidth of the electrical stimulation signal 320. By sampling at a lower rate, only the lower frequency components of the signal are sampled. In order to avoid having higher frequency components leaving traces (or artifacts) in the down-sampled signal, some embodiments apply a low-pass filter as part of the down-sampling process. The down-sampler 306 down-samples based on a down-sample factor. For some embodiments of the bone conduction device 250, the electrical stimulation signal 320 has a 8 kilohertz (kHz) bandwidth and the down-sampler 306 preferably down-samples the signal by a down-sample factor of four. Thus, the signal output by the down-sampler 306 will only have a bandwidth of 2 kHz (i.e, 8 kHz divided by 4). In other embodiments, the electrical stimulation signal 320 has a 10 kHz bandwidth and the down-sampler 306 down-samples the signal by a down-sample factor of eight. Thus, the signal output by the down-sampler 306 will only have a bandwidth of 1.25 kHz (i.e, 10 kHz divided by 8). The down-sample factor in other embodiments may vary with the bandwidth of the electrical stimulation signal. The bandwidth of the down-sampler output is preferably between 1 and 2 kHz, though bandwidths outside of this range are within the scope of the invention.

In some embodiments, the output of the down-sampler 306 is routed to buffer 308. The buffer 308 may temporarily store the output of the down-sampler 306. In some embodiments, the down-sampler 306 stores the down-sampled signal for a finite period of time. In other embodiments, the buffer 308 is continuously updated with the output from the down-sampler 306. In yet further embodiments, the buffer 308 takes a sample of the output of the down-sampler 306 at finite periods of time. In some embodiments, it may desirable to store the down-sampled signal as low-frequency feedback may be less time variant. For example, low frequency feedback doesn't change as rapidly as high frequency feedback. Thus, it may be desirable for the feedback reduction circuit to generally operate on the non-down-sampled signal and switch to operating on the down-sampled signal periodically. In some embodiments, a processor may determine dynamically when to operate on the down-sampled signal. For example, in some embodiments, when low frequency feedback is detected, sound processor system 300 may cause the feedback reduction circuit to begin operating on the down-sampled signal.

At filter block 310, a signal received by the filter block 310 is filtered. In some embodiments, the filter block 310 does not receive both the down-sampled signal from the down-sampler 306 and the non-down-sampled electrical stimulation signal 320 at the same time. In other embodiments, the filter block 310 receives both the down-sampled signal from the down-sampler 306 and the non-down-sampled electrical stimulation signal 320. In the illustrated example, the filter block 310 has one output. This output may vary between an output based on the down-sampled signal and an output based on the non-down-sampled electrical stimulation signal 320. Generally, the filter block 310 produces an output signal that can be used to remove feedback from the system as will be described in further detail herein after.

In one example, the filter block 310 is configured with a finite number of taps. The number of taps for a filter defines, at least in part, both the resolution of the filter and the processing requirements. For example, as a number of taps in a filter is increased, the resolution of the filter increases. However, the computational power required for filtering also increases with the number of taps. Thus, filters are typically designed based on processing and resolution requirements. It may be desirable, especially in battery powered devices, to use a filter with as few taps as is reasonable.

In some embodiments, the filter block 310 is configured with 40 taps. The number of taps relates to the resolution of the filter. For example, if a signal has a 10 kilohertz (kHz) bandwidth and the filter has 40 taps, each tap will have a 250 Hz resolution (i.e., 10 kHz divided by 40 taps). By increasing the number of taps, the resolution of the filter block 310 may be increased. However, increasing the resolution of the filter block 310 will increase the required processing power exponentially (and reduce battery life accordingly).

In the present example, to the down-sampler 306 effectively increase the resolution of the filter block 310. As one example, through down-sampling by a factor of eight, an original 10 kHz signal will have a bandwidth of 1.25 kHz. Consequently, the filter block 310 can filter a 1.25 kHz signal across the 40 taps, compared to the original 10 kHz signal. Thus, the resolution of the filter effectively increases to 31.25 hertz (Hz) (i.e., 1.25 kHz divided by 40 taps). Therefore, by down-sampling the signal by a factor of eight, the filter may have an associated increase in resolution by a factor of eight. Additionally, filter block 310 may also perform functions similar to those of filter block 408, first pre-whitening block 410, least-mean squared (LMS) block 412, and second pre-whitening block 414 of FIG. 4, as described below.

In the illustrated embodiment, the output of the filter block 310 is coupled to switch 314. The switch 314 is configured to selectively connect the output of the filter block 310 to either up-sampler 316 or directly to the combiner 318. In one example, when the filter block 310 is filtering the down-sampled signal, the switch 314 couples the output of the filter block 310 to the up-sampler 316. The up-sampler 316 is configured to up-sample the down-sampled signal by an up-sample factor proportional to the down-sample factor utilized by the down-sampler 306 to down-sample the electrical stimulation signal 320. For example, if the electrical stimulation signal 320 was down-sampled by a factor of eight, then the up-sampler 316 can up-sample the down-sampled signal by a factor of eight. After up-sampling by the up-sampler 316, a signal will be generated with the same bandwidth as the electrical stimulation signal 320 (before down-sampling), but only contain the low frequency components.

After the up-sampler 316, the output up-sampled signal is passed to combiner 318. In addition to the output from the up-sampler 316, the combiner 318 can also receive the filtered non-down-sampled (full-bandwidth) electrical stimulation signal 320 from the filter block 310 via the switch 314. In some embodiments (e.g., the embodiment of FIG. 3), the combiner 318 only receives one of these two signals at any given time. However, in other embodiments, the combiner 318 receives both signals at the same time.

The combiner 318 uses the input signal(s) from the feedback circuit (the output of up-sampler 316 and the full-bandwidth output of the filter block 310) and input signal 302 to create a feedback-reduced signal for processing block 304. The combiner 318 may combine the signals in a variety of ways to reduce feedback. In one embodiment, the combiner 318 may be an analog mixer that combines two or more signals. When the signals are mixed in an analog mixer, two (or more) signals are mixed and some components of the signals may be amplified through constructive interference or reduced by destructive interference. In other embodiments, the combiner adds an inverse of the up-sampler 316 output to the input signal 302 in order to remove feedback.

In still another embodiment, the combiner 318 is another filter. For example, combiner 318 may be a dynamic filter that filters the input signal 302 based on the input signal(s) from the feedback circuit (the output of up-sampler 316 and the full-bandwidth signal output of the filter block 310). Such a dynamic filter may use the full-spectrum information from the full-bandwidth signal to identify acoustic feedback in the system and minimize the identified feedback. Alternatively or in conjunction, the dynamic filter may use the output from the up-sampler 316 to identify further feedback in the system. Because the output of the up-sampler 316 is based on the reduced-bandwidth down-sampled signal, it will contain more information about low frequency feedback that is in the system. Thus, the output of the up-sampler 316 may be used to more accurately remove low frequency feedback from the system. In some embodiments, the low frequency feedback may be reduced after the feedback has been reduced based on the non-down-sampled signal. For example, using the buffer 308, it is possible to feed the up-sampler with the oldest subset of the down-sampled signal which will, when up-sampled, match the length of input signal 302. The combining could then consist of a simple saturated addition in the time domain. At the next time frame, the second oldest subset from 302 will be combined, and so on. In the other end, buffer 308 will receive a down-sampled block that originates from the input signal 302 in order to keep the buffer full at all times.

Still further variations of the embodiment described in connection with FIG. 3 are within the scope of the invention. For example, in some embodiments, a plurality of down-samplers, including down-sampler 306 are coupled in parallel. Each down-sampler in such embodiments preferably acts on a different frequency band. For example, in some such embodiments, a first of the down-samplers acts on a 0 to 1 kHz frequency band and a second acts on a 0 to 4 kHz frequency band. In such embodiments, a suitable down-sample factor for the first down-sampler is 4 and a suitable down-sampler factor for the second down-sampler is 2. The down-sampler frequency bands overlap in those embodiments, but in other embodiments, the frequency bands are distinct (e.g., 0 to 1 kHz and 3 to 4 kHz, respectively). Because feedback in the lowest frequencies typically changes infrequently, the down-sampler operating on the lowest frequencies in some such embodiments is utilized the least often. A second down-sampler in such embodiments might operate more often, but less often than the full-bandwidth signal is utilized. In still other embodiments, the full-bandwidth signal is not coupled to the filter 310.

Figure 4:
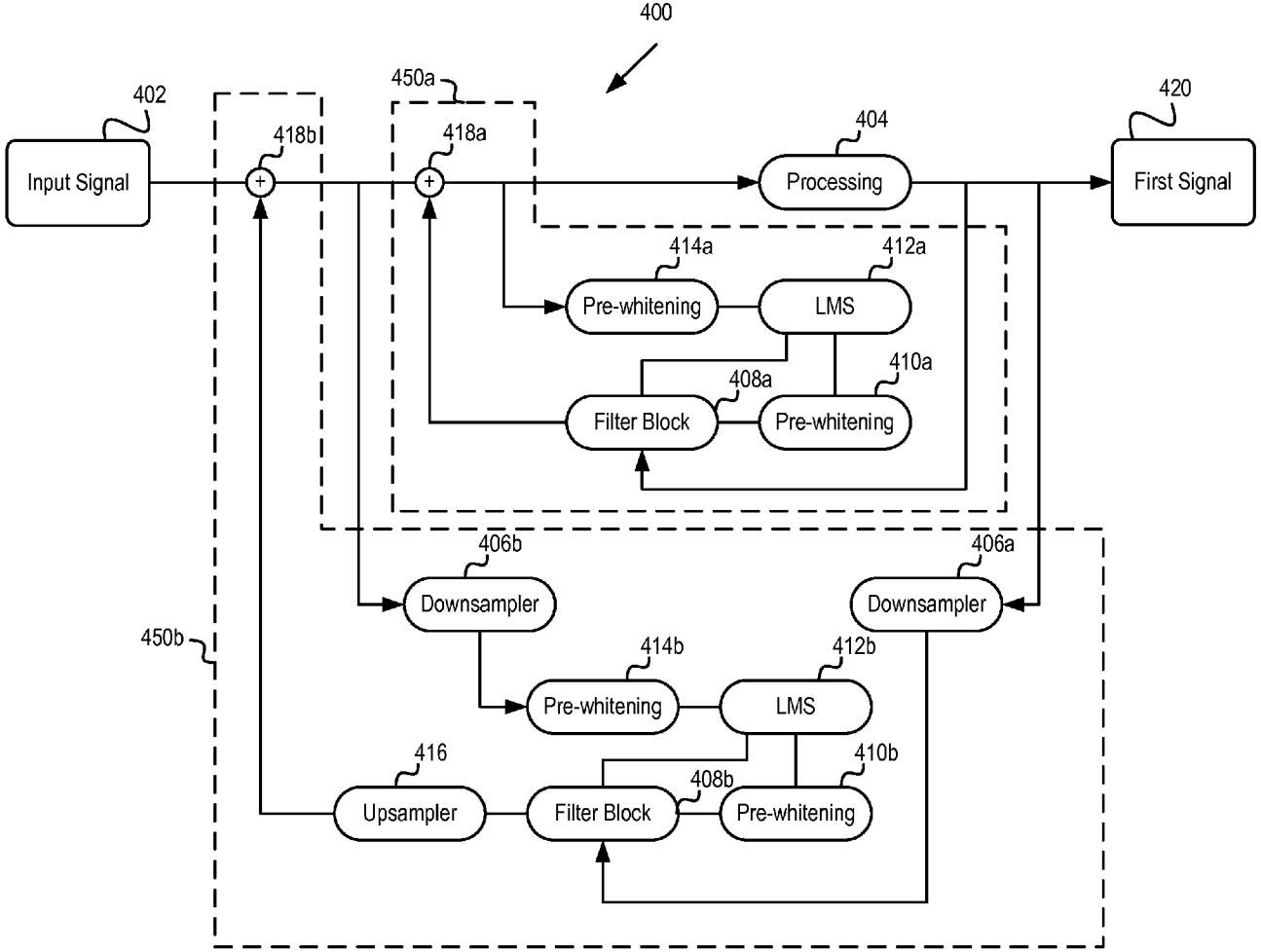
FIG. 4 is a block diagram of a sound processor including dual feedback reduction circuits, in accordance with one example.

FIG. 4 is a block diagram of a sound processor system 400 including dual feedback reduction circuits. Some components of sound processor system 400 may have a similar function as corresponding components of the system 300 (of FIG. 3). As part of sound processor system 400 (similar to the sound processor 104 of FIG. 1), the sound processor 404 receives an input audio signal 402 and transforms the input signal into an output such as electrical stimulation signal 420. The sound processor system 400 may perform audio processing at processing block 404. In some embodiments, a hearing prosthesis is programmed with parameters specific to a given prosthesis recipient and the processing block 404 may transform the input signal 402 based on these patient-specific parameters. For example, recipient-specific parameters include acoustic gain tables, frequency response curves, and other audio parameters. In some embodiments, the patient-specific parameters are based on a hearing impairment associated with the prosthesis recipient.

In order to minimize feedback in the system 400, dual-feedback reduction circuits similar to the example shown in FIG. 4 may be used. The components of the system 400 are organized in one example layout. The components may be arranged in a different combination and still function as disclosed herein. Further, some components may be omitted and other components may be added.

The sound processor system 400 features feedback reduction circuits 450*a* and 450*b*. More particularly, each illustrated feedback reduction circuit 450*a* and 450*b* is made up of filter blocks 408*a* and 408*b*, pre-whitening block 410*a* and 410*b*, least-mean squared (LMS) blocks 412*a* and 412*b*, second pre-whitening blocks 414*a* and 414*b*, and combiners 418*a* and 418*b* respectively. In other embodiments, however, the two combiners, 418*a* and 418*b* may be configured as a single combiner unit. Feedback reduction circuit 450*b* is additionally made up of down-samplers 406*a* and 406*b* and up-sampler 416. In alternate embodiments, feedback reduction circuit 450*a* may also include one or more down and up samplers.

Regarding feedback reduction circuit 450*b*, the inclusion of down-samplers 406*a* and 406*b* and up-sampler 416 means that feedback reduction circuits 450*a* and 450*b* are able to operate on different, but overlapping frequency bands. Thus, if a given device implementing embodiments of this invention is subject to, e.g., low frequency feedback, feedback reduction circuit 450*b* may be configured via down-sampler 406*a* or 406*b* to reduce feedback in a low frequency range, and feedback reduction circuit 450*a* maybe be configured to reduce feedback in some or all of that frequency range in addition to other frequencies. Thus, any artifacts that remain in the output of the feedback reduction circuit 450*b* can be addressed by feedback reduction circuit 450*a*.

The down-samplers 406*a* and 406*b* and the up-sampler 416 function in a very similar manner to the down-sampler 306 and up-sampler 316 of FIG. 3. The down-samplers 406*a* and 406*b* are configured to down-sample their respective inputs at a lower rate than would be used to sample the full-bandwidth of the respective inputs. Similar as to what was described above with respect to FIG. 3, the maximum frequency that can be sampled is a function of the sampling rate. Thus, by choosing a sampling rate that is lower than what is required to sample the full frequency spectrum of the signal, the signal can be downsampled. By down-sampling at this lower rate, the lower frequency components of the signal may be sampled with a higher resolution.

The down-samplers 406*a* and 406*b* may down-sample based on a down-sample factor. Typically, both down-samplers 406*a* and 406*b* will sample the respective input signals with the same down-sample factor. However, in some embodiments, the down-sample factor may be different between the two down-samplers 406*a* and 406*b*. For example, both the input signal 402 and the electrical stimulation signal 420 may have a 10 kHz bandwidth and the down-samplers 406*a* and 406*b* may down-sample by a down-sample factor of eight. Thus, the signal output by the down-samplers 406*a* and 406*b* will have a bandwidth of 1.25 kHz (i.e., 10 kHz divided by 8). Additionally, by limiting the maximum frequencies that are sampled by the sampling, the filters may have a higher resolution across the frequency band sampled by the down-samplers 406*a* and 406*b*.

The up-sampler 416 will up-sample the previously down-sampled signals that are received from the filter block 408*b*. More particularly, the down-sampled signal received from the filter block 408*b* will be up-sampled by an up-sample factor that is proportional to the down-sample factor utilized by the down-sampler 406*a* and/or the down-sampler 406*b* to down-sample the input signal 402 and/or the electronic stimulation signal 420, respectively. After up-sampling by the up-sampler 416, the resulting signal will have the same bandwidth as the original input signal 402 and the electrical stimulation signal 420. Thus, the resulting signal from the up-sampler 416 will have the same bandwidth as the original signals (before down-sampling), but only contain the low frequency components.

Each component that makes up the feedback reduction circuits 450*a* and 450*b* may behave in a similar manner to the corresponding component in the other feedback manager. For example, both LMS 412*a* and 412*b* may behave similarly, but operate on different signals. Thus, the function of each component of the feedback reduction circuits will be described with respect to just one of the feedback reduction circuits.

The filter block 408*a* may function in a similar manner to the filter block 310 of FIG. 3. At filter block 408*a*, a signal coupled to the filter block 408*a* is filtered. In some embodiments, such as feedback reduction circuit 450*a*, the filter block 408*a* filters the electrical stimulation signal 420. However, in other embodiments, such as feedback reduction circuit 450*b*, the filter block 408*b* filters a down-sampled version of the electrical stimulation signal 420 received from the down-sampler 406*a*. The filter block 408*a* may determine components for each signal that is received. In some embodiments, the filter block 408*a* may only have one output that is coupled to the combiner 418*a*. However, in other embodiments, the filter block 408*a* may provide another output signal coupled to other components in the system 400, such as to the feedback reduction circuit 450*b*. Generally, the filter blocks 408*a*, 408*b* create signals that can be used by the combiners 418*a*, 418*b* to remove feedback from the system 300, as will be described in more detail hereinafter.

Like the filter block 310 of FIG. 3, the filter block 408*a* can have a limited resolution due to being configured with a finite number of taps. In some embodiments, the filter block 408*a* has 40 taps. The number of taps relates to the resolution of the filter. For example, if a signal has a 10 kilohertz (kHz) bandwidth and the filter has 40 taps, each tap will have a 250 Hz resolution. By increasing the number of taps, the resolution of the filter block 408*a* may be increased; however, increasing filter block 408*a* resolution will typically increase the required processing power (and reduce battery life).

The LMS block 412*a*, receives an input from pre-whitening block 414*a* and pre-whitening block 410*a*. The LMS block 412*a* looks for a correlation between the two input signals it receives. Based on these, it may provide an estimation of the feedback path.

For example, pre-whitening block 414*a* may receive a version of the input signal 402. The pre-whitener block 414*a* may apply pre-whitening to the input signal 402 (such as auto-leveling, etc.). Additionally, pre-whitening block 410*a* may receive a version of the electrical stimulation signal 420 that has been filtered by filter block 408*a*. The pre-whitener block 410*a* may apply pre-whitening to its input signal (such as auto-leveling, etc.). The LMS block 412*a* receives both of these pre-whitened signals and makes a correlation measurement. The portion of the signal that is highly correlated may be feedback. The LMS block 412*a* may use a least-mean squared method to determine correlation. Other algorithms to determine correlation may be used as well. In some additional embodiments, both the pre-whitening block 414*a* and the pre-whitening block 410*a* may be omitted. In some embodiments, by creating a signal that is the inverse of the correlated signal detected by the LMS block and adding it to the input signal, a portion of the correlated signal (i.e. feedback) may be removed or cancelled out.

In some situations, the LMS block attempts to remove feedback based on the autocorrelation of a signal. Autocorrelation is an indication of how similar a signal is to itself. For example, a pure tone is completely correlated; thus, it may be misidentified as feedback. The pre-whitening filters may be used to mitigate the possibility of the LMS block identifying a highly auto-correlated signal as being feedback. You can then filter both the input signal 402 and a version of the electrical stimulation signal 420 with the same filter and then cross-correlate the filtered responses. In signal processing a "white" signal means when each sample is independent statistically from every other sample. If you add the pre-whitening each sample will be less correlated with the rest of the samples. Thus, the pre-whitening will help to reduce audible artifacts from when the algorithm is acting on high auto-correlated signals such as pure tones.

The LMS block 412*a* may output an indication of the feedback to the filter block 408*a*. The filter block 408*a* may be an estimated filter that the feedback reduction system determines should be applied to eliminate all of the feedback. The feedback reduction system looks frame by frame and works to eliminate feedback that remains.

Figure 5:
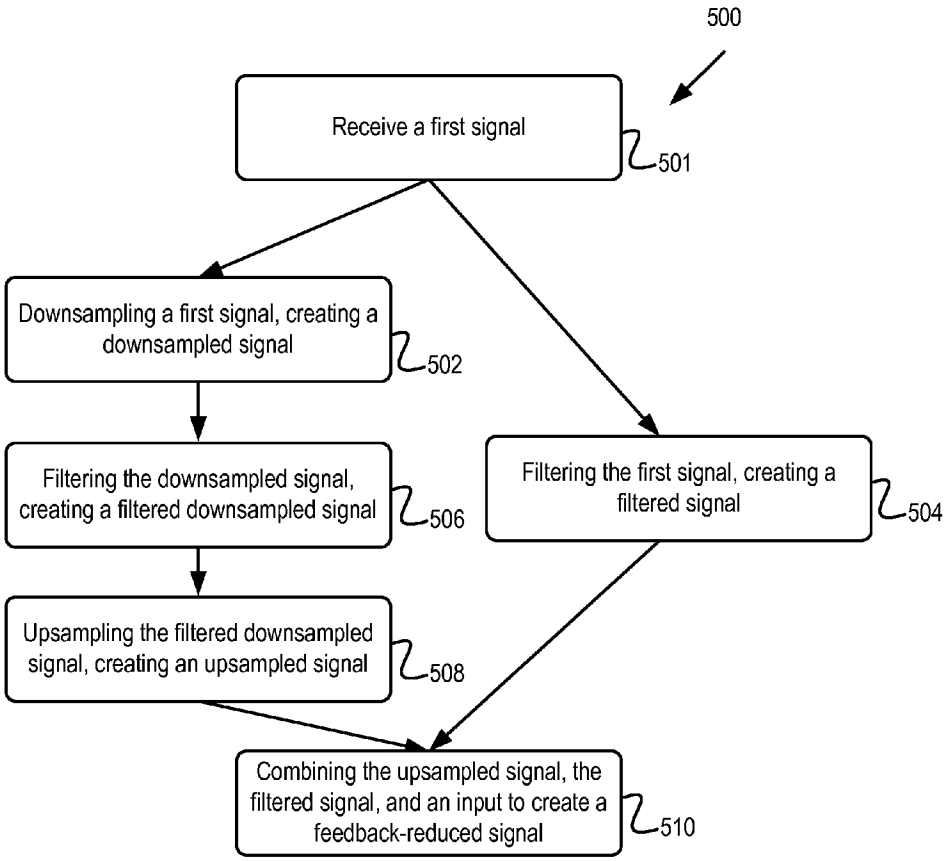
FIG. 5 is an example flowchart of a method for reducing feedback for a sound processor system.

FIG. 5 is one example method 500 for a feedback reduction system. As part of method 500, a sound processor, such as the sound processor 104 of FIG. 1, receives a first signal at block 501 and ultimately transforms the first signal into a feedback-reduced signal at block 510. Method 500 is one example layout for an example method. In different embodiments, some blocks may be combined, added, or omitted. Additionally, some blocks may be performed in parallel or in sequence. Further, method 500 may be performed by a processor located within or otherwise associated with the hearing prosthesis.

The method 500 may operate with two signal paths. After the first signal is received by the sound processor at block 501, the processor down-samples the first signal to create a down-sampled signal at block 502. More specifically, at block 502 the sound processor samples the first signal at a rate below the sampling rate required to sample the full-bandwidth of the first signal. By down-sampling the signal, the first signal is essentially low-pass filtered. Thus, the signal resulting from block 502 has a smaller bandwidth than the original first signal. In some embodiments, the signal is down-sampled based on a down-sample factor.

At block 506, the down-sampled signal is filtered to create a filtered down-sampled signal. The filtering at block 506 may be used to determine a feedback component of the first signal. A filter having a finite number of taps performs filtering at block 506. In some embodiments, the filter has 40 taps. The number of taps will relate to the resolution of the filter. For example, if the first signal has a 10 kHz bandwidth and was down-sampled by a factor of eight, the signal to be filtered at block 506 will have a bandwidth of 1.25 kHz (i.e., 10 kHz divided by eight). If the filter at block 506 has 40 taps, each tap will then have a 31.25 Hz effective resolution (i.e., 1.25 kHz divided by 40).

Similar to block 506, block 504 also performs filtering. However, block 504 filters the full-bandwidth first signal creating a filtered signal. For example, if the first signal has a 10 kilohertz (kHz) bandwidth and the filter has 40 taps, each tap will have a 250 Hz resolution. Thus, the full-bandwidth signal is filtered at a lower resolution than the down-sampled signal.

After the down-sampled signal is filtered at block 506, it will be up-sampled at block 508 to create an up-sampled signal. At block 508, the sound processor will up-sample the filtered down-sampled signal using an up-sample factor that is proportional to the down-sample factor used at the down-sampling block 502. By up-sampling, the bandwidth of the signal is increased. In one example, after up-sampling at the block 508, the resulting signal will have the same bandwidth as the original first signal from block 501.

At block 510, the up-sampled signal from block 508, the filtered signal from block 504, and an input signal, such as an input from a microphone, will be combined. Through this combining, feedback that may be introduced in the hearing prosthesis system may be removed. In some embodiments, the combining takes the form of filtering. For example, a filter may be created based on the up-sampled signal and the filtered signal.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. A signal processing system comprising:

a first process circuit configured to generate a first processed signal from an input to the first process circuit based on a first signal; and a second process circuit configured to generate a second processed signal from the first processed signal based on a second signal, wherein the first signal is the first processed signal or an output of the signal processing system, wherein the second signal is the second processed signal or the output of the signal processing system, wherein the first process circuit operates on a first frequency band and the second process circuit operates on a second frequency band, and wherein the first frequency band is limited to low frequency components of the first processed signal or low frequency components of the output of the signal processing system.

2. The signal processing system of claim 1, further comprising processing circuitry, wherein an input of the processing circuitry is configured to receive the second processed signal, and an output of the processing circuitry is configured to provide the output of the signal processing system.

3. The signal processing system of claim 1, wherein the first and second frequency bands are different, and the first and second frequency bands overlap.

4. The signal processing system of claim 3, wherein the second frequency band is a full bandwidth of the second processed signal or of the output of the signal processing system.

5. The signal processing system of claim 1, wherein the first process circuit comprises a first down-sampler, a filter, an up-sampler, and a combiner, and wherein an input of the first process circuit is an input to the first down-sampler, an output of the first down-sampler is coupled to an input of the filter, an output of the filter is coupled to an input of the up-sampler, and an output of the up-sampler is coupled to an input of the combiner.

6. The signal processing system of claim 5, wherein the input of the first down-sampler is configured to receive the first processed signal.

7. The signal processing system of claim 5, wherein the first process circuit further comprises a second down-sampler, wherein the output of the signal processing system is coupled to an input of the second down-sampler, an output of the second down-sampler is coupled to an input to the filter, and the combiner is configured to provide the first processed signal.

8. The signal processing system of claim 7, wherein the first down-sampler and the second down-sampler are configured to sample respective input signals using the same down-sample factor.

9. The signal processing system of claim 1, wherein the first process circuit is configured to downsample the input to the first process circuit.

10. A method of operating a signal processing system comprising a signal path, the method comprising:

down-sampling, outside the signal path, a first signal from the signal path to thereby create a second signal;

filtering, outside the signal path, the second signal to thereby create a third signal;

up-sampling, outside the signal path, the third signal to thereby create a fourth signal;

filtering, outside the signal path, the first signal to thereby create a fifth signal; altering a sixth signal inside the signal path based on at least one of the fourth signal or the fifth signal, wherein filtering the second signal operates on a first frequency band, and filtering the first signal operates on a second frequency band.

11. The method of claim 10, further comprising combining the fourth and fifth signals, and wherein altering the sixth signal includes altering the sixth signal based on the combined fourth and fifth signals.

12. The method of claim 11, further comprising combining the fourth and fifth signals with a seventh signal to thereby create the sixth signal.

13. The method of claim 12, wherein the seventh signal is a microphone input signal.

14. The method of claim 10, wherein the first and second frequency bands are different, and the first and second frequency bands overlap.

15. The method of claim 14, wherein the first frequency band is narrower than the second frequency band.

16. The method of claim 14, wherein the first frequency band is limited to low frequency components of the first signal.

17. The method of claim 10, wherein altering the sixth signal based on at least one of the fourth signal or the fifth signal thereby creates the first signal.

18. The method of claim 10, wherein the first signal is representative of at least one of the fourth signal, the fifth signal, or an output of the signal path.

19. The method of claim 10, further comprising:

down-sampling, outside the signal path, a seventh signal to thereby create an eighth signal;

filtering, outside the signal path, the eighth signal to thereby create a ninth signal; and up-sampling, outside the signal path, the ninth signal to thereby create a tenth signal, and wherein altering the sixth signal inside the signal path is based on at least one of the fourth signal, the fifth signal, or the tenth signal.

20. A signal processing system comprising:

a first process circuit configured to generate a first processed signal from an input to the first process circuit based on a first signal; and a second process circuit configured to generate a second processed signal from the first processed signal based on a second signal, wherein the first signal is the first processed signal or an output of the signal processing system, wherein the second signal is the second processed signal or the output of the signal processing system, wherein the first process circuit operates on a first frequency band and the second process circuit operates on a second frequency band, wherein the first and second frequency bands are different, the first and second frequency bands overlap, and wherein the second frequency band is a full bandwidth of the second processed signal or of the output of the signal processing system.

21. The signal processing system of claim 20, further comprising processing circuitry, wherein an input of the processing circuitry is configured to receive the second processed signal, and an output of the processing circuitry is configured to provide the output of the signal processing system.

22. The signal processing system of claim 20, wherein the first frequency band is limited to low frequency components of the first processed signal or low frequency components of the output of the signal processing system.

23. The signal processing system of claim 20, wherein the first process circuit comprises a first down-sampler, a filter, an up-sampler, and a combiner, and wherein an input of the first process circuit is an input to the first down-sampler, an output of the first down-sampler is coupled to an input of the filter, an output of the filter is coupled to an input of the up-sampler, and an output of the up-sampler is coupled to an input of the combiner.

24. The signal processing system of claim 23, wherein the input of the first down-sampler is configured to receive the first processed signal.

25. The signal processing system of claim 23, wherein the first process circuit further comprises a second down-sampler, wherein the output of the signal processing system is coupled to an input of the second down-sampler, an output of the second down-sampler is coupled to an input to the filter, and the combiner is configured to provide the first processed signal.

26. The signal processing system of claim 25, wherein the first down-sampler and the second down-sampler are configured to sample respective input signals using the same down-sample factor.

27. The signal processing system of claim 20, wherein the first process circuit is configured to downsample the input to the first process circuit.

* * * * *